US008558463B2

(12) United States Patent
Sato et al.

(10) Patent No.: US 8,558,463 B2
(45) Date of Patent: Oct. 15, 2013

(54) LED MATRIX OPEN/SHORT DETECTION APPARATUS AND METHOD

(75) Inventors: Etsuji Sato, Singapore (SG); Chun Kiong Leslie Khoo, Singapore (SG); Jiong Fu, Singapore (SG); Maung Zabu Ko, Singapore (SG); Shuang Zhang, Singapore (SG); Muhammad S/O Abuturab, Singapore (SG)

(73) Assignees: Panasonic Corporation, Osaka (JP); Panasonic Semiconductor Asia Pte. Ltd., Singapore (SG)

( * ) Notice: Subject to any disclaimer, the term of this patent is extended or adjusted under 35 U.S.C. 154(b) by 325 days.

(21) Appl. No.: 13/004,283

(22) Filed: Jan. 11, 2011

(65) Prior Publication Data

US 2012/0176039 A1 Jul. 12, 2012

(51) Int. Cl.

| | |
|---|---|
| ***H01J 1/60*** | (2006.01) |
| ***H01J 7/42*** | (2006.01) |
| ***H05B 37/04*** | (2006.01) |
| *H05B 37/02* | (2006.01) |
| *H05B 39/04* | (2006.01) |
| *H05B 41/36* | (2006.01) |
| *H05B 37/00* | (2006.01) |
| *H05B 39/00* | (2006.01) |
| *H05B 41/00* | (2006.01) |
| *G05F 1/00* | (2006.01) |

(52) U.S. Cl.
USPC ..... 315/130; 315/210; 315/297; 315/320

(58) Field of Classification Search
None
See application file for complete search history.

(56) References Cited

U.S. PATENT DOCUMENTS

| | | | | |
|---|---|---|---|---|
| 6,888,454 | B2 | 5/2005 | Kurose | |
| 7,446,481 | B2 * | 11/2008 | Kang et al. | 315/185 R |
| 7,675,246 | B2 * | 3/2010 | Chiang et al. | 315/291 |
| 2003/0160703 | A1 | 8/2003 | Kurose | |
| 2010/0181941 | A1 * | 7/2010 | Kuo et al. | 315/320 |

OTHER PUBLICATIONS

U.S. Appl. No. 12/732,292 to Wee Sien Hong et al., which was filed Mar. 26, 2010.

* cited by examiner

*Primary Examiner* — Douglas W Owens
*Assistant Examiner* — Dedei K Hammond
(74) *Attorney, Agent, or Firm* — Greenblum & Bernstein, P.L.C.

(57) ABSTRACT

An apparatus to detect faulty connection of LED (open/short conditions) which may affect the function of LED display panel is presented. The apparatus basically controls the switches through control algorithm circuit to get the information of LED driver output pins voltage and compare them with two reference voltages to determine the open/short condition of individual LED.

14 Claims, 13 Drawing Sheets

LED MATRIX OPEN/SHORT DETECTION APPARATUS AND METHOD

BACKGROUND OF THE INVENTION

The present invention relates to an LED driver system incorporating an added open/short detection system, and more particularly to LED matrix open/short detection apparatus and method for detecting and indicating a faulty LED connection in LED display panel 200. LED display panel can be used as backlight or displaying character or indicating lights in many applications. If there is a fault in LED connection, the function of LED display panel will be affected and it cannot fulfill the purpose of applications.

There are two types of LED connections in most of the applications arranged in matrix form: normal conventional connection and cross-plex connection as shown in FIGS. 1B and 1A. In both connections, there are control algorithm circuit 300, LED driver system 100 which consists of power MOS 105 to 108 for conventional and 106 to 109 for cross-plex, PWM controlled current sources 101 to 104 for conventional and 101 to 105 for cross-plex connection, and LED panel 200 which consists of LEDs 201 to 216. As shown in FIG. 1B, for normal conventional connection, power MOS 105 controlled by Y1 and PWM controlled current source 104 controlled by X1, must be turned on to light up LED A1 201, where A1 is the coordinates of the particular LED in the matrix. But for the cross-plex connection shown in FIG. 1A, power MOS 106 controlled by Y1 and PWM controlled current source 104 controlled by X2 must be turned on in order to light up LED A1 201. In cross-plex connection, turning on the corresponding Y and X together at the same time (e.g. Y1 and X1, Y2 and X2 and so on) is prohibited.

Conventional means to detect open/short connection in the LED panel 200 would be to use current injection technique, as described in US2003/0160703 (Fault Diagnosis Circuit For LED Indicating Light) by Takahiro Kurose and Sakai-shi.

This technique, however, cannot be used for cross-plex LED connection and cannot detect individual LED faulty connection. This is because, the technique used in US2003/0160703 is designed for individual LEDs arranged in the conventional connection, and hence will not work properly for cross-plex connection. It also uses many components in the system. It is the objective of the present invention to overcome the abovementioned problems associated with the prior art, and is able to be utilized for detecting open/short conditions for individual LED in both conventional and cross-plex connections.

SUMMARY OF INVENTION

The present invention proposes a novel system to enable detection of the open or short condition of individual LEDs arranged in the conventional or cross-plex connections. A typical LED driver application system would comprise of a logic block receiving input from a user for determination of display on the LED panel. The logic block would be coupled to an LED driver system that would drive the actual LED panel coupled to its output. According to a preferred embodiment, the present invention builds upon the LED driver system, incorporating an additional system for detection of the open or short condition of the individual LEDs in the LED panel.

According to the present invention, an apparatus and method to detect the open or short condition of an LED comprises of blocks namely a control algorithm circuit, a level shifter circuit, an LED driver system, a connection switches circuit, a comparator, a reference generation circuit, a signal pass block and an output pass block.

According to the present invention, the functions of the above blocks are described as a control algorithm circuit to control the workings and sequence of operation of the apparatus; a level shifter circuit to level shift the input DC voltage levels to a first reference DC voltage level; an LED driver system to control the LED display panel; a connection switches circuit to connect individual LED output pins to a non-inverting input terminal of a comparator; a comparator to compare the LED output pins with a second and third reference voltages; a reference generation circuit to generate the second and third reference voltages; a signal pass block to allow conditional outputting of the LED output pin select signals outputted by the control algorithm circuit, based on the Enable signal; and a output pass block to allow conditional outputting of the status of the open or short condition of the LED under test, based on the Enable signal.

An exemplary output terminal to which the status output signal is coupled to, which may be exemplarily referred to as OSDETOUT for purpose of explanation, is further coupled to an input of a logic block to store this status output signal at a pre-defined register address. The stored status output information may be retrieved later to check on the respective LEDs' status as needed in subsequent front-end operations.

The purpose of this invention is to provide an apparatus and method to detect the open or short condition of an LED.

According to the present invention, an apparatus and method to detect the open or short condition of an LED, comprises:

a control algorithm circuit to control the workings and sequence of operation of the apparatus;

a level shifter circuit to level shift the input DC voltage levels to a first reference DC voltage level;

an LED driver system to control the LED display panel;

a connection switches circuit to connect individual LED output pins to a non-inverting input terminal of a comparator;

a comparator to compare the LED output pins with a second and third reference voltages;

a reference generation circuit to generate the second and third reference voltages;

a signal pass block to allow conditional outputting of the LED output pin select signals outputted by the control algorithm circuit, based on the Enable signal; and an output pass block to allow conditional outputting of the status of the open or short condition of the LED under test, based on the Enable signal.

According to the present invention, the first reference voltage is a first power supply voltage.

According to the present invention, the second reference voltage is generated by voltage dividing a second power supply voltage.

According to the present invention, the third reference voltage is generated via a small voltage drop across a resistor from a third power supply voltage.

According to the present invention, the second reference voltage is lower in amplitude compared to the third reference voltage.

According to the present invention, the third power supply voltage is the same as the first supply voltage.

According to the present invention, the connection switches circuit comprise of a combination of a plurality of switches.

According to the present invention, the switches are transmission gates.

According to the present invention, a method for detecting the open or short condition of an LED, comprises:

generating two reference voltages to act as thresholds to determine the open or short conditions; and comparing the output pins one-by-one with the generated two reference voltages.

According to the present invention, the two reference voltages are of significantly difference voltage levels so as to enable differentiation between the open or short conditions.

DETAILED DESCRIPTION OF THE PREFERRED EMBODIMENTS

Figure 1A:
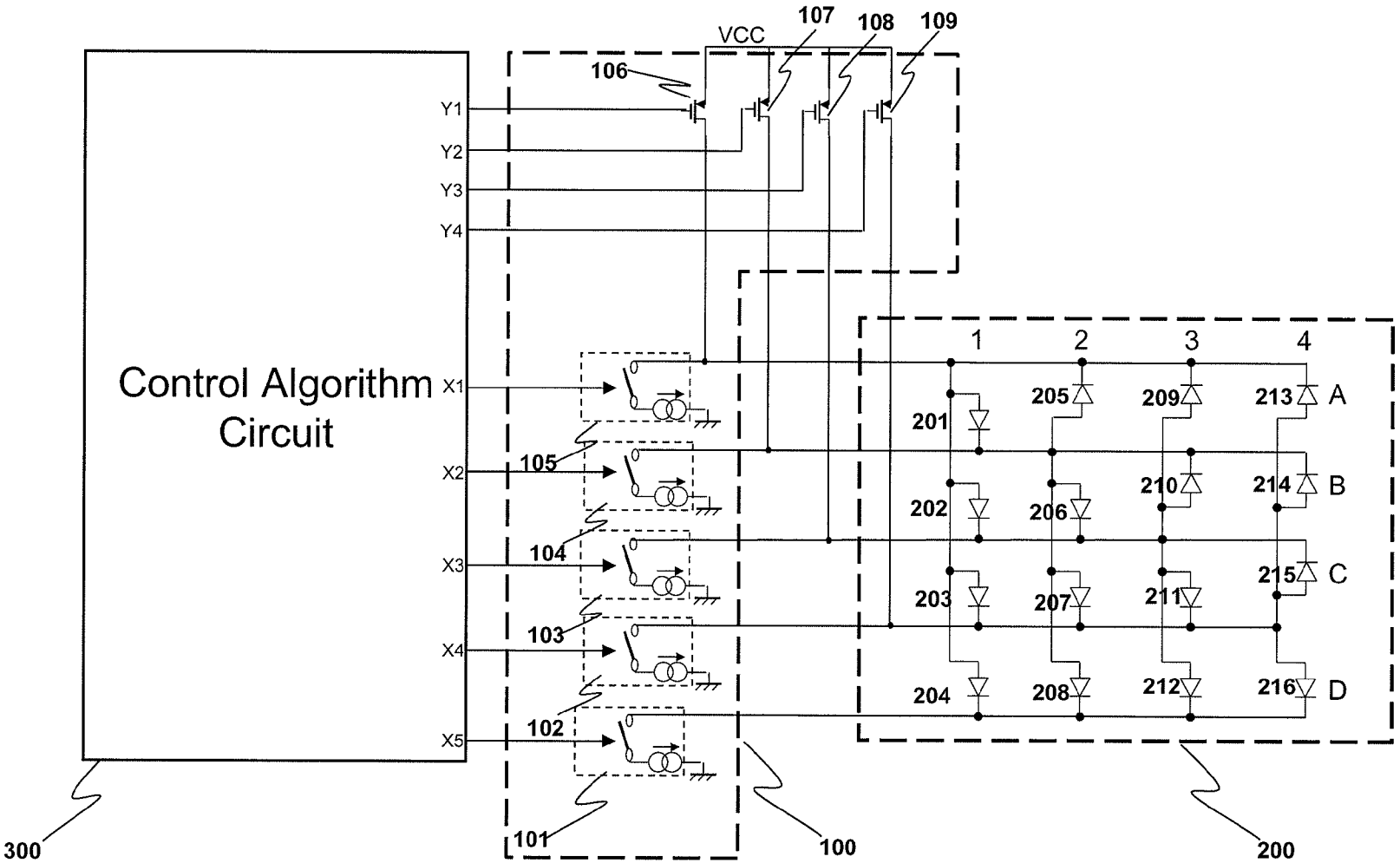
FIG. 1A is a circuit diagram showing a cross-plex LED connections.
Figure 1B:
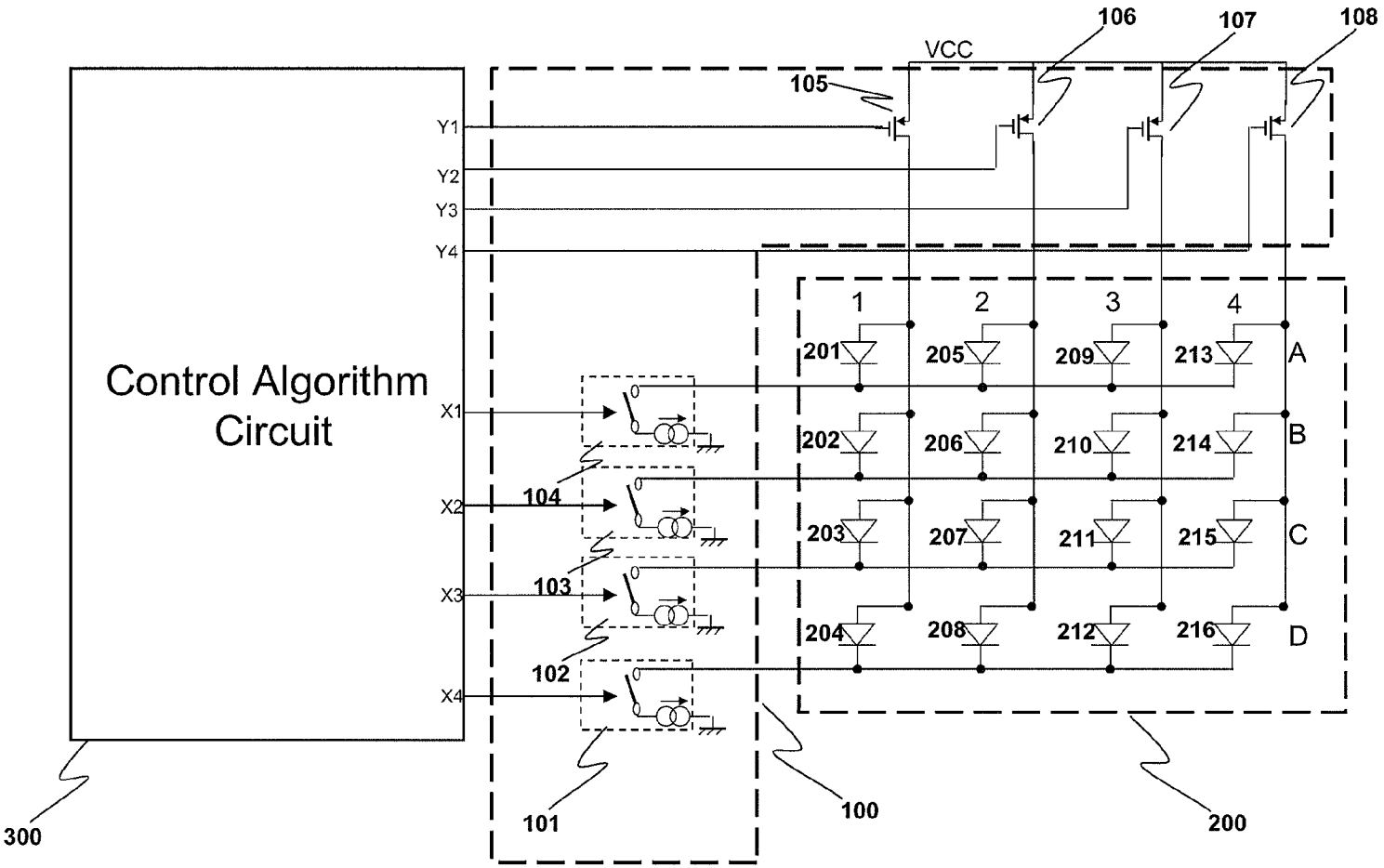
FIG. 1B is a circuit diagram showing a normal conventional LED connections.
Figure 2A:
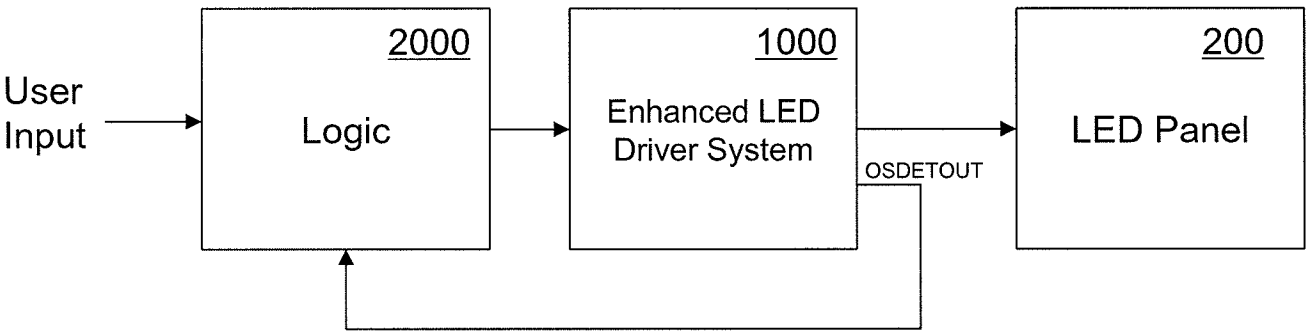
FIG. 2A is a block diagram of a typical full LED driver application system.

Referring to FIG. 2A, the present invention, exemplarily referred to as Enhanced LED Driver System 1000, builds upon the existing LED driver system 100 by incorporating an open/short detection system to check the status of the individual LEDs in the LED panel 200. The Enhanced LED Driver System 1000 is typically coupled to a logic block 2000 at its input, which further accepts user requests for specific displays on the LED panel 200. The Enhanced LED Driver System 1000 also has an output terminal, exemplarily referred to as OSDETOUT, which is coupled to an input of the logic block 2000. OSDETOUT outputs a status output signal. The logic block 2000 will then store this status output signal at a pre-defined register address. The stored status output information may be retrieved later to check on the respective LEDs' status as needed in subsequent front-end operations.

Figure 2B:
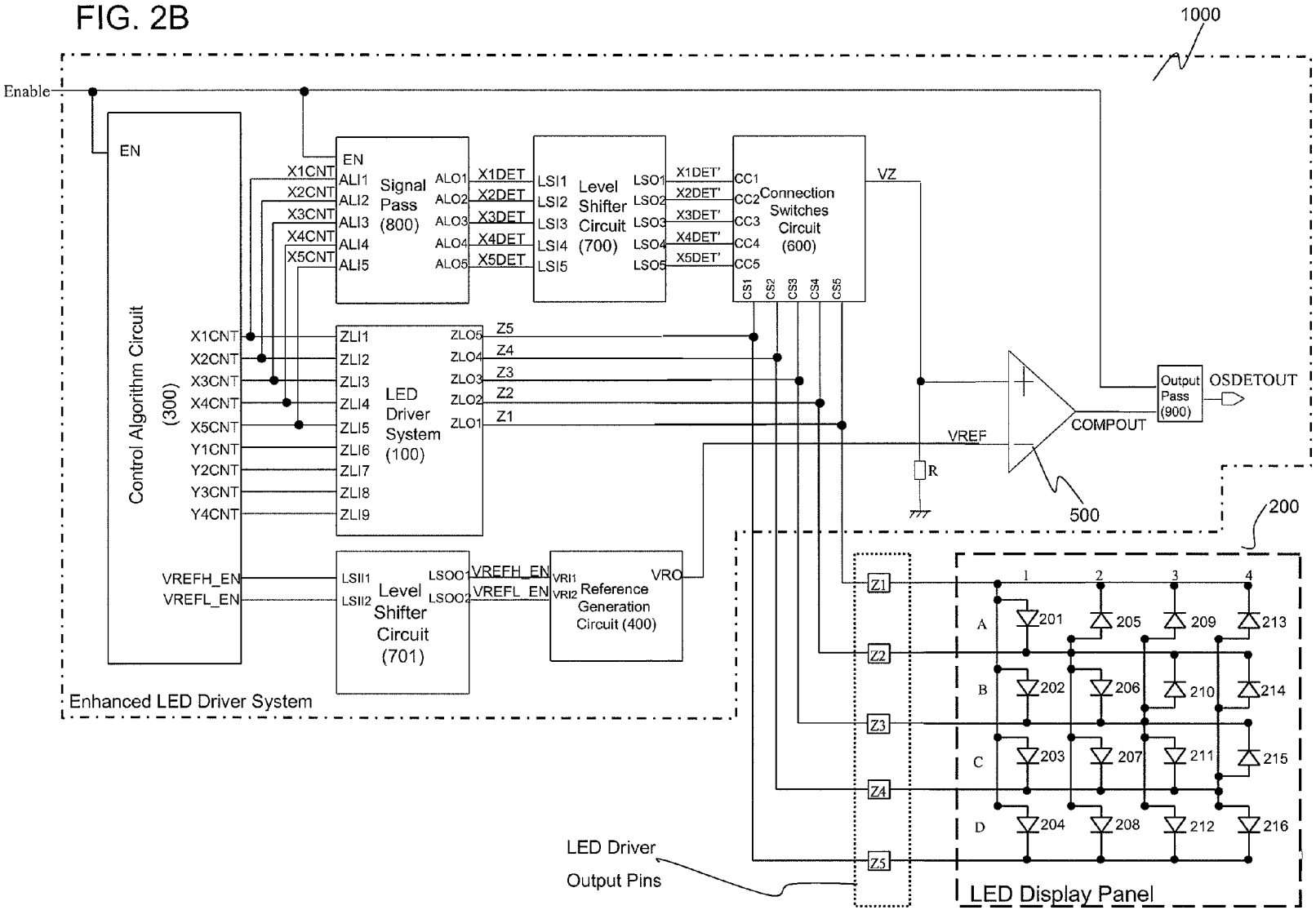
FIG. 2B is a block diagram of present invention.

Referring to FIG. 2B, the first preferred embodiment of a method and apparatus to detect a faulty LED connection which will affect the function of LED display panel 200, according to the present invention, is presented. The present invention basically compares an LED output pin voltage with two reference voltages to detect either open of short faulty condition of LED.

An LED Driver System 100 to control the display of LED panel 200 has its inputs coupled to the Control Algorithm Circuit 300's output terminals X1CNT, X2CNT, X3CNT, X4CNT, X5CNT, Y1CNT, Y2CNT, Y3CNT and Y4CNT. The LED driver system 100 outputs ZLO1, ZLO2, ZLO3, ZLO4 and ZLO5 are further coupled to the Connection Switches Circuit 600 via its input terminals CS1, CS2, CS3, CS4 and CS5. Connection Switches Circuit 600 functions to connect to LED output pin terminals for comparison of the voltage levels with the two reference voltages. The output terminal VZ of the Connection Switches Circuit 600 is coupled to the non-inverting terminal of a comparator 500. The LED output pin terminals being referred to here are the output terminals typically present on an LED display panel 200.

The two reference voltages are generated by the Reference Generation Circuit 400. Reference Generation Circuit 400 outputs a voltage level VREF via its output terminal VRO, which is coupled to the inverting input of the comparator 500.

The comparison of the LED output pin voltage levels with the two reference voltages is performed by the comparator 500.

Figure 2C:
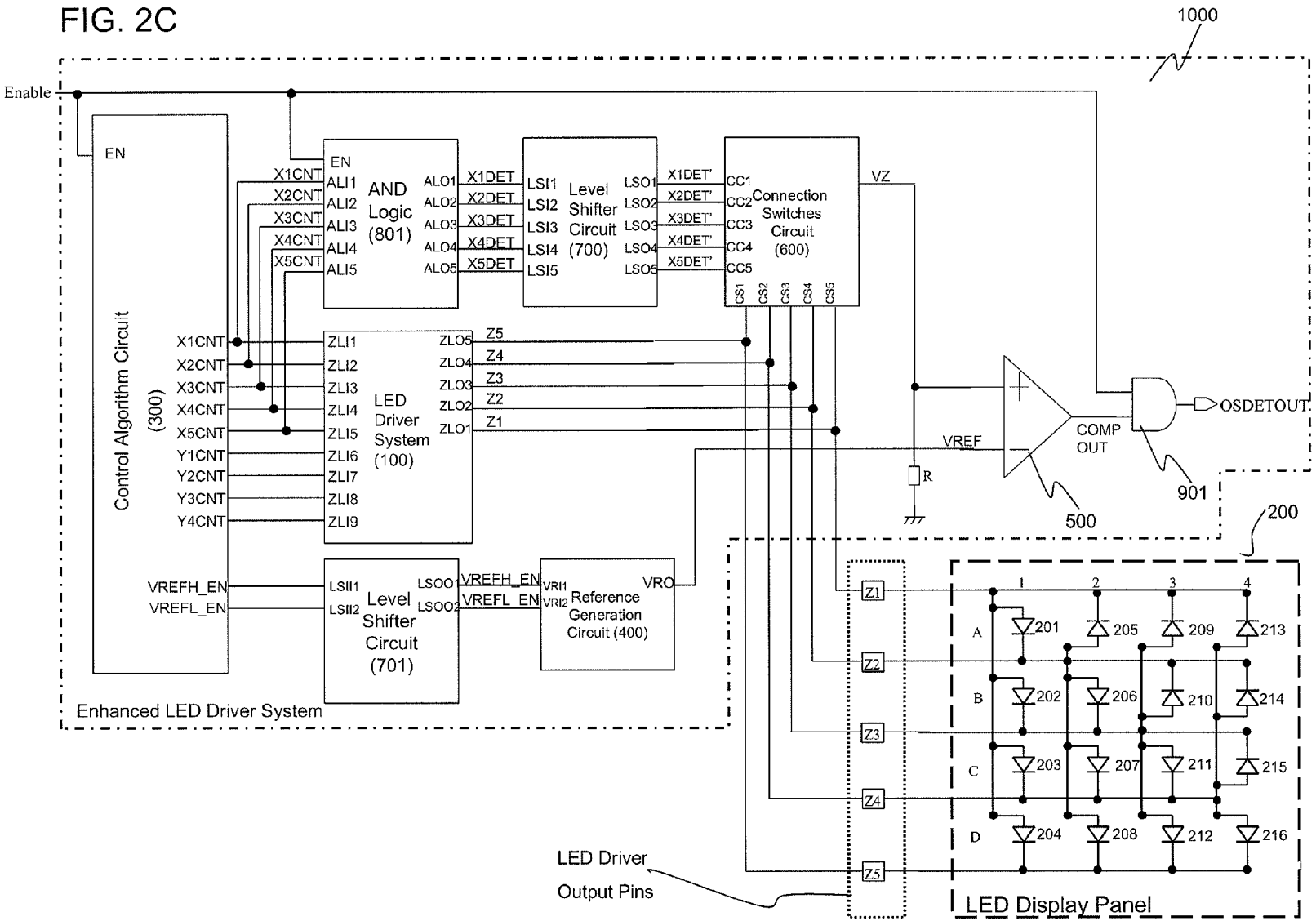
FIG. 2C is a block diagram of present invention, with an exemplary implementation of the output pass block using an AND gate, and the signal pass block using an AND logic circuit.

The Control Algorithm Circuit 300 controls the LED driver system and switches;

Function of Level Shifter Circuits 700 and 701 is to level shifting the input DC voltage levels to VCC level. Input terminals LSI1, LSI2, LSI3, LSI4 and LSI5 of the Level Shifter Circuit 700 couple to the output terminals ALO1, ALO2, ALO3, ALO4 and ALO5 of a Signal Pass block 800, which may be exemplarily implemented using an AND Logic block 801, as shown in FIG. 2C; while output terminals LSO1, LSO2, LSO3, LSO4 and LSO5 of the Level Shifter Circuit 700 couple to the input terminals CC1, CC2, CC3, CC4 and CC5 of the Connection Switches Circuit 600. Further to that, Input terminals LSII1 and LSII2 of the Level Shifter Circuit 701 couple to the output terminals VREF-H_EN and VREFL_EN of the Control Algorithm Circuit 300; while output terminals LSOO1 and LSOO2 of the Level Shifter Circuit 701 couple to the input terminals VRI1 and VRI2 of the Reference Generation Circuit 400.

The output of the comparator 500, COMPOUT is further coupled to an input terminal of an output pass block 900. The output pass block 900 functions to allow the COMPOUT signal to pass through to the OSDETOUT terminal only when the Enhanced LED Driver system 1000 is enabled.

An exemplarily implementation of the output pass block 900 is an AND gate 901, as shown in FIG. 2C. For this exemplary implementation, the COMPOUT signal is coupled to one of the input terminals of an AND gate 901, while the other input terminal of the AND gate 901 is coupled to an Enable signal. The output OSDETOUT of the AND gate 901 will give the indication of the status of the corresponding LED condition under test.

Figure 3A:
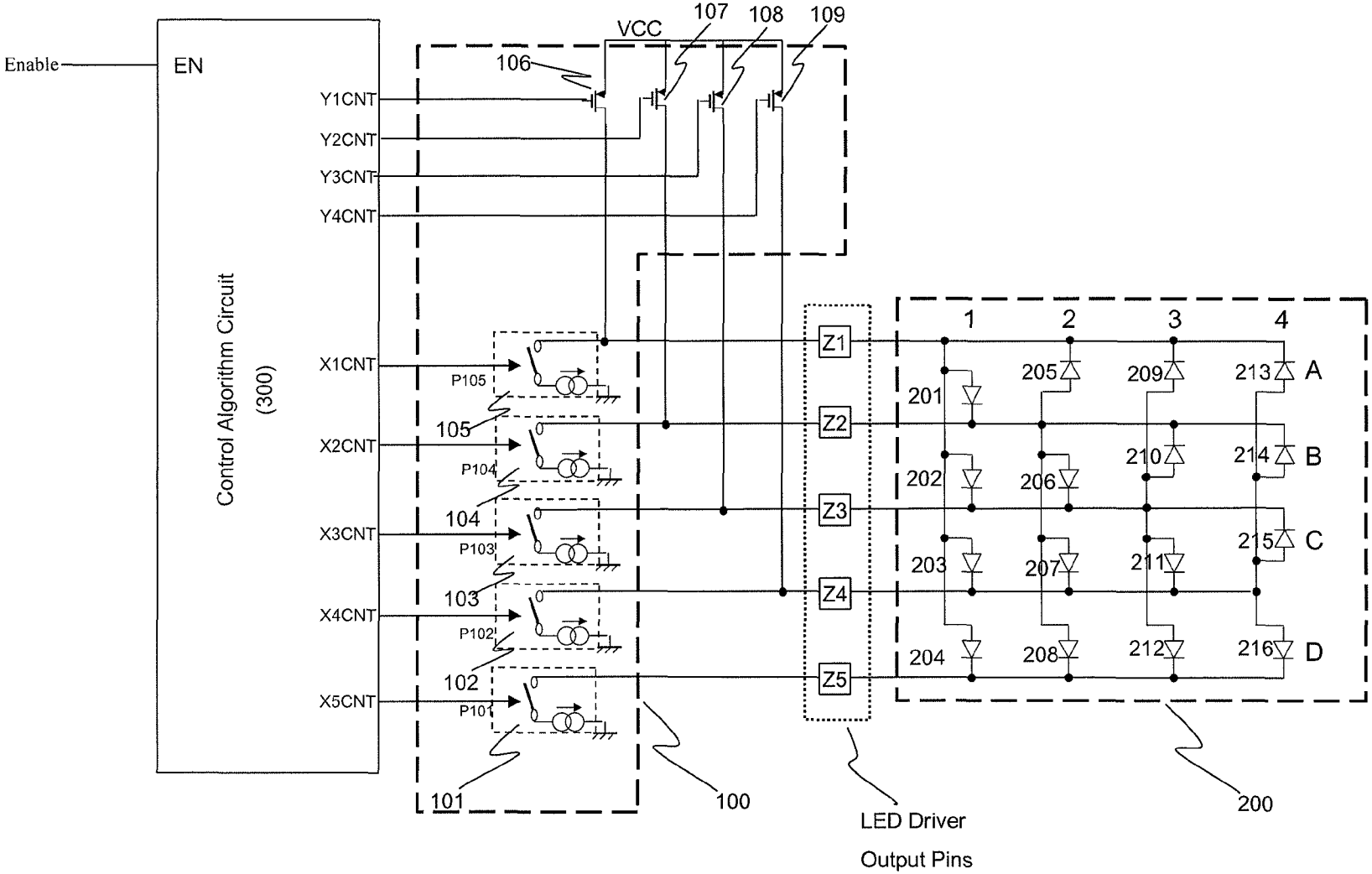
FIG. 3A is an exemplary implementation of first embodiment of the present invention, highlighting LED Driver System block.

The LED Driver System 100 may be exemplarily implemented as shown in FIG. 3A via power MOS 106, 107, 108 and 109; and PWM control current sources 101, 102, 103, 104 and 105. The control pins P101, P102, P103, P104 and P105 of the PWM control sources are coupled to the output terminals X1CNT, X2CNT, X3CNT, X4CNT and X5CNT of the Control Algorithm Circuit 300.

Individual LED can be lit up by controlling of Y*CNT and X*CNT. For example, when power MOS 106 and PWM control current source 104 are turned on through Y1CNT and X2CNT, LED A1 201 will light up. Corresponding Y*CNT and X*CNT cannot turn on at the same time (i.e. Y1CNT and X1CNT or Y2CNT and X2CNT, etc, cannot be turned on at the same time).

Figure 3B:
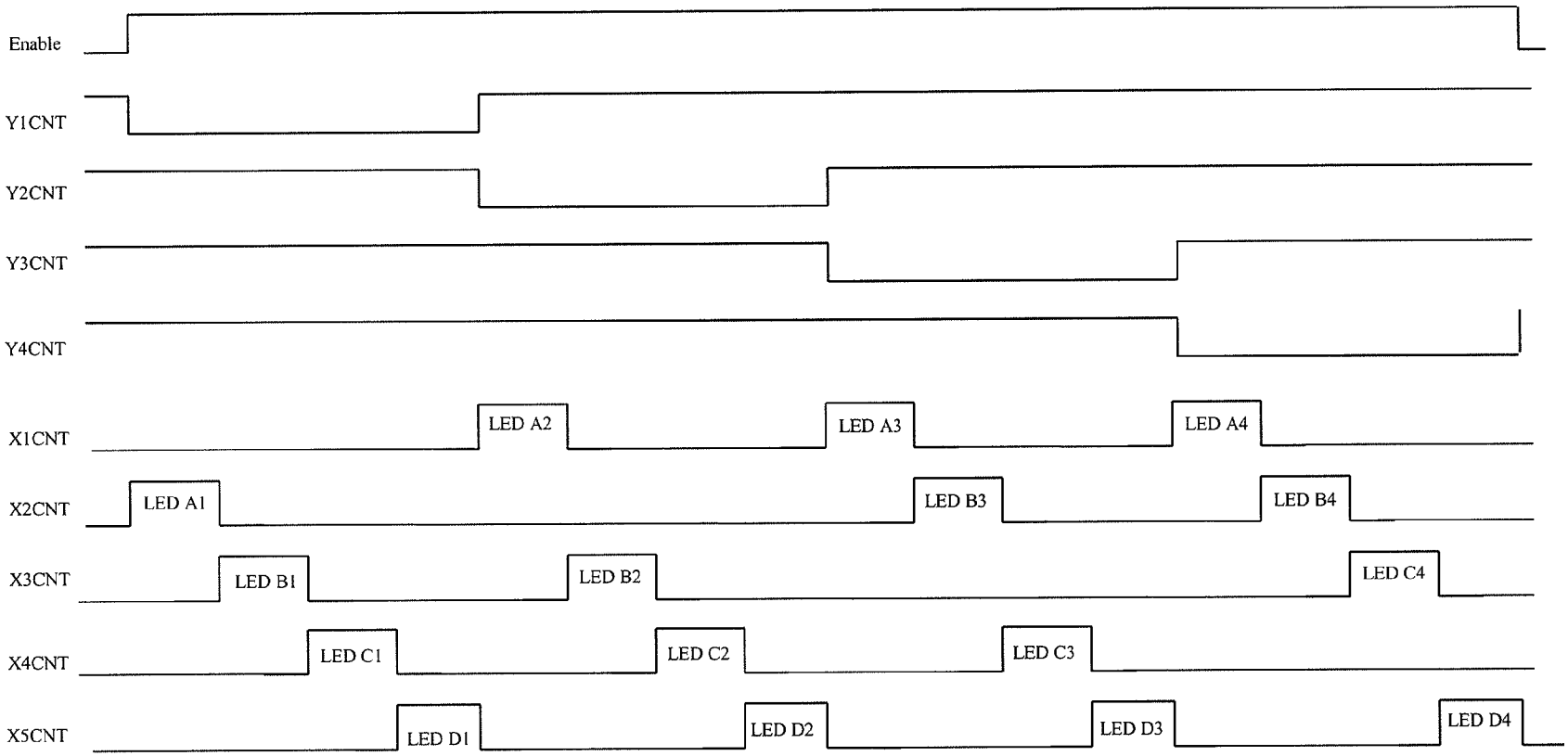
FIG. 3B is an exemplary waveform showing the turning on of individual LED due to scanning.

When Enhanced LED Driver system 1000 is enabled via terminal EN, control algorithm circuit will start scanning to check individual LED connection. At first, Y1CNT will turn on followed by Y2CNT and so on. As shown in FIG. 3B, during Y*CNT turning on period, X*CNT, except from corresponding XCNT will be scanned. For example, when Y1CNT is turned on, X2CNT to X5CNT will scan but not X1CNT. This is to check individual LED connections.

Figure 3C:
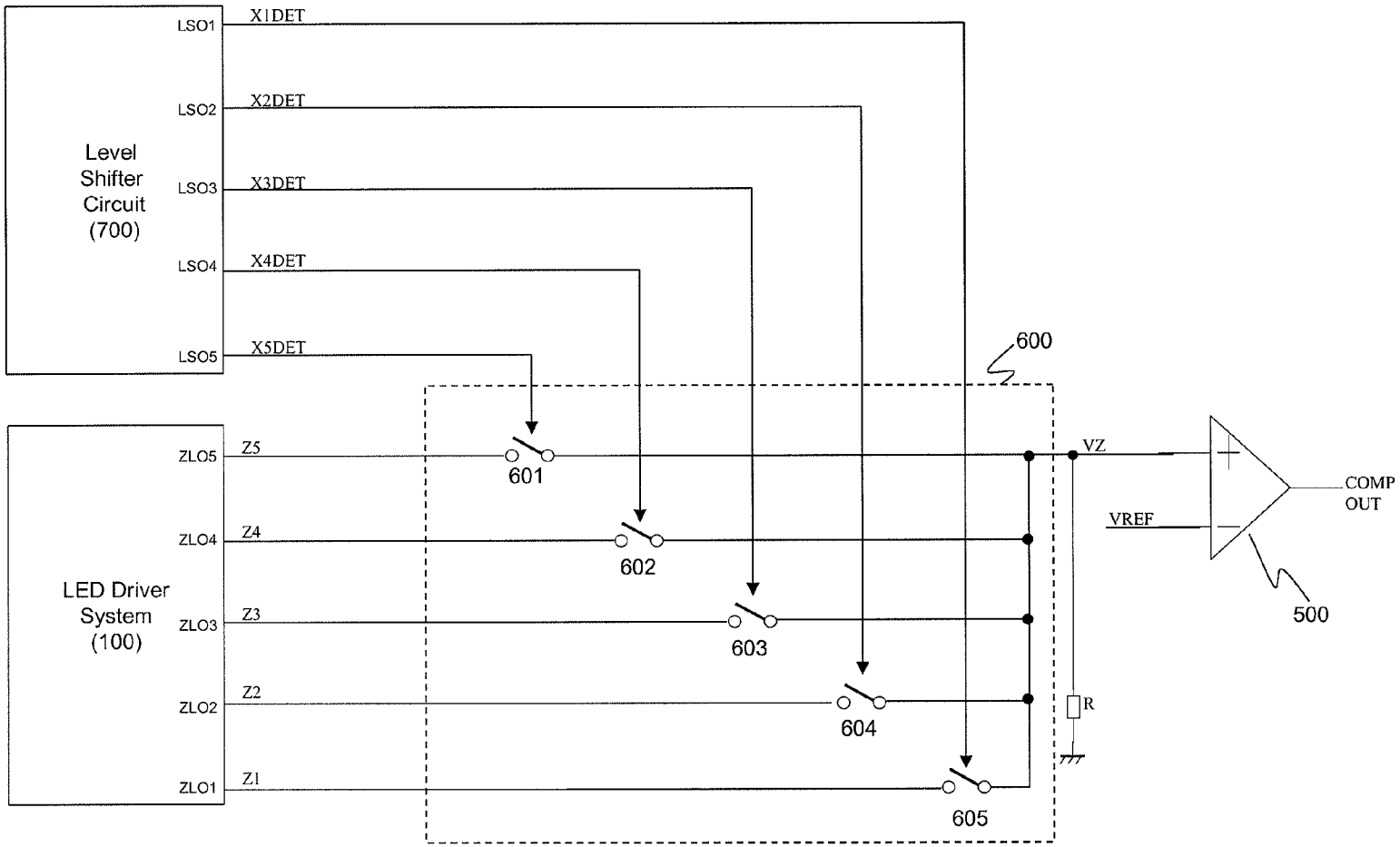
FIG. 3C is an exemplary implementation of second embodiment of the present invention, highlighting connection switches block.

Referring to FIG. 3C, an exemplary implementation of the Connection Switches Circuit 600 based on the present invention is shown.

As shown in FIG. 3C, Connection switches circuit 600 consists of switches 601 to 605 which connect LED output pin voltages (Z1 to Z5) to the comparator 500. As shown in FIG. 3E, transmission gates types may be exemplarily implemented for switches 601 to 605. These switches 601 to 605 are controlled by X*DET signals which are X*CNT signals from control algorithm circuit 300 that are allowed to pass through the Signal Pass block 800 when the Enhanced LED Driver system 1000 is enabled. An exemplary implementation of the Signal Pass block 800 for this step is by using the AND logic circuit 801, where the X*CNT signals from control algorithm circuit 300 "AND" together with the "Enable" signal. We shall refer to the X*CNT signals as LED output pin select signals.

When Enhanced LED Driver system 1000 is enabled, switches will start scanning as X*CNT signals are scanning. Only one switch will turn on at one time connecting individual LED output pin voltage (Z1 to Z5) to the non-inverting terminal of the comparator 500 as shown in FIG. 3C. The LED output pin voltage (Z1 to Z5) will compare with reference voltages, VREF (high and low) to check for open or short condition of the individual LED.

Figure 3D:
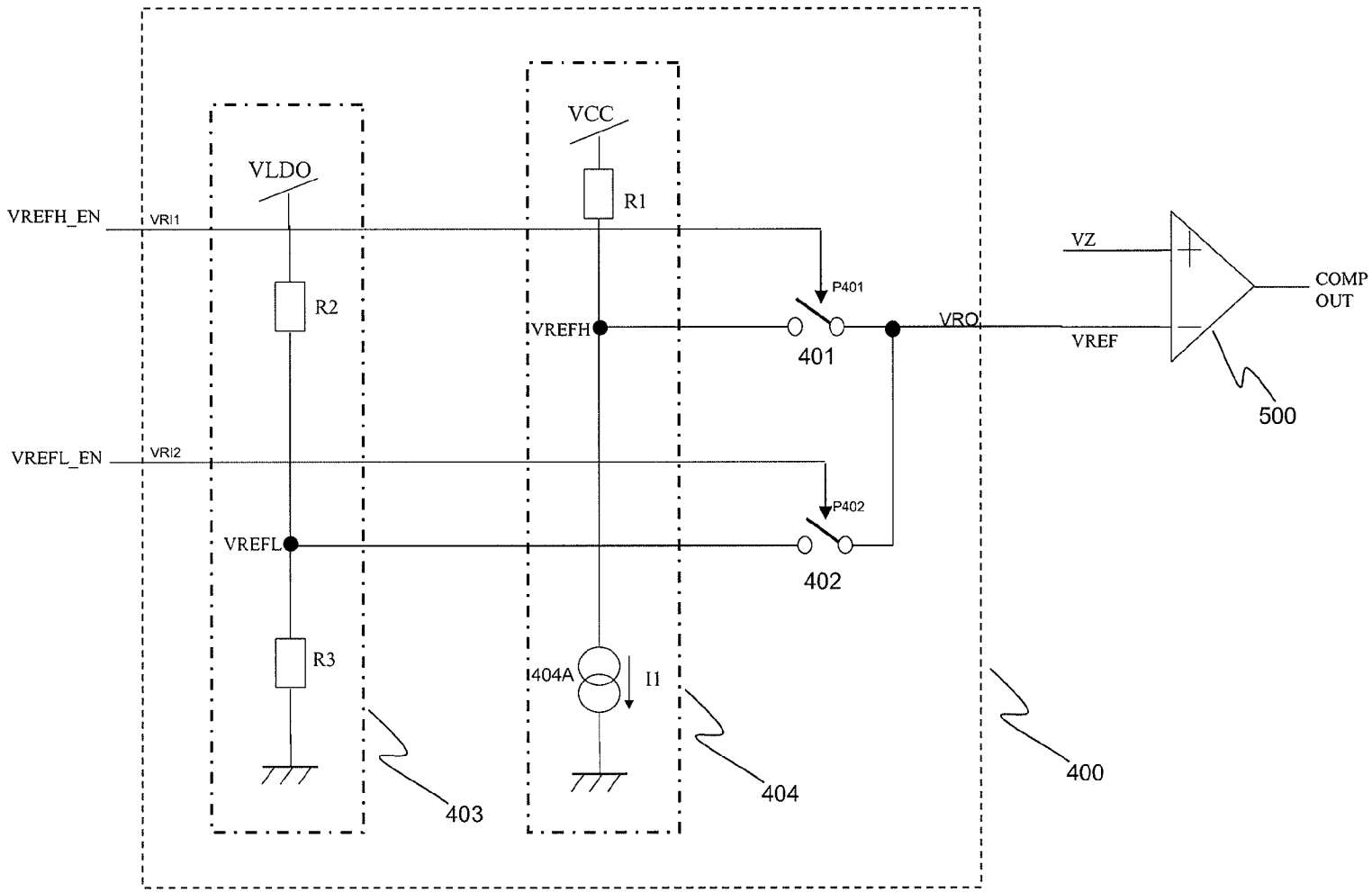
FIG. 3D is an exemplary implementation of third embodiment of the present invention, highlighting reference generating block.
Figure 3E:
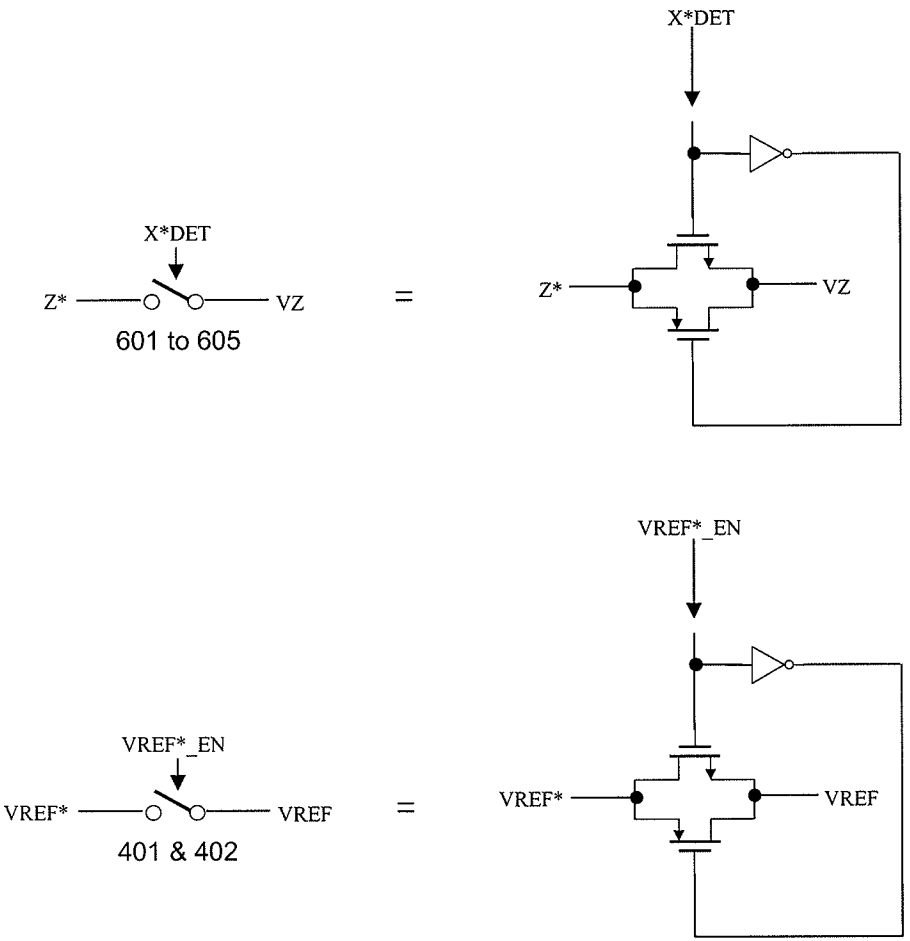
FIG. 3E is a transmission gate, as exemplarily used for switches 401,402, 601 to 605.

Referring to FIG. 3D, an exemplary implementation of the Reference Generation Circuit 400 based on the present invention is shown.

As shown, the Reference Generation Circuit 400 consists of the combination of resistor R1 and current source 404A to make up VREFH generation circuit 404 and resistor divider circuit 403 to generate high and low reference voltages, VREFH and VREFL respectively. Resistor divider circuit 403 comprises of resistors R2 and R3 dividing a supply voltage VLDO. The power supply for the VREFH generation circuit 404 is denoted by VCC. The Reference Generation Circuit 400 also consists of connection switches 401 and 402 to connect either high reference voltage VREFH or low reference voltage VREFL to the inverting terminal of the comparator 500 (VREF) as shown in FIG. 3D. The voltage level output at output terminal VRO shall be referred to as VREF. The switches 401 and 402 are controlled via control pins P401 and P402 respectively, by VREFH_EN and VREFL_EN signals from the Control Algorithm Circuit 300. The VREFH_EN and VREFL_EN signals are inputted to the Reference Generation Circuit 400 through input terminals VR11 and VR12 respectively.

The high and low reference voltages, VREFH and VREFL, can be calculated as follows:

$$VREFH=VCC-(I1\times R1)$$

$$VREFL=VLDO\times[R3/(R2+R3)]$$

Figure 3F:
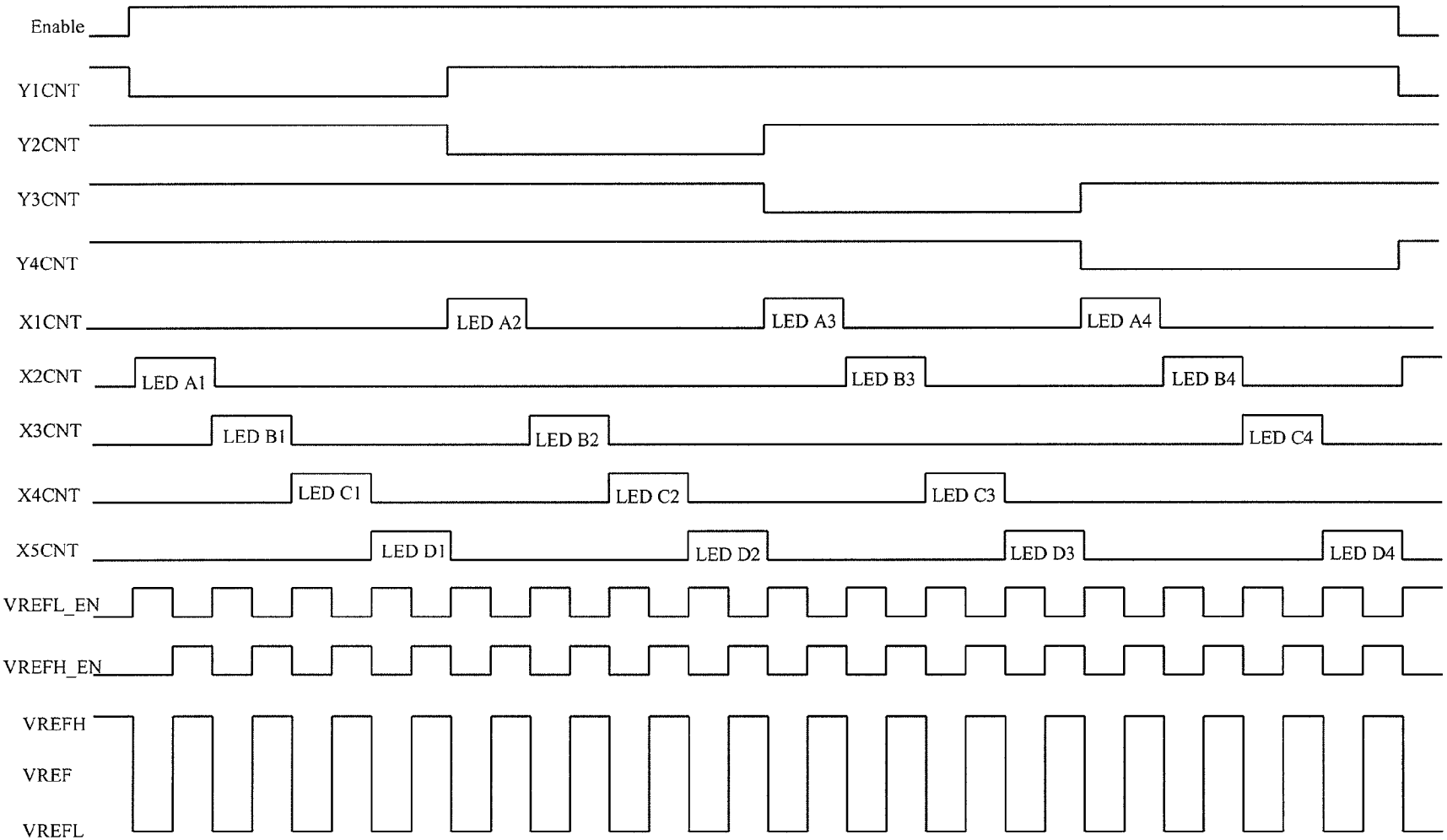
FIG. 3F is an exemplary waveform showing reference voltage (VREF) changing between high and low reference during individual LED scanning.

When Enhanced LED Driver system 1000 is enabled via the Enable signal, VREFL_EN and VREFH_EN will turn on alternatively during the X*CNT 'ON' periods. The inverting terminal of the comparator 500 will be switching between VREFH and VREFL. The waveforms for these signals are as shown in FIG. 3F.

The operation of the present invention shall be described in the following paragraphs.

Figure 3G:
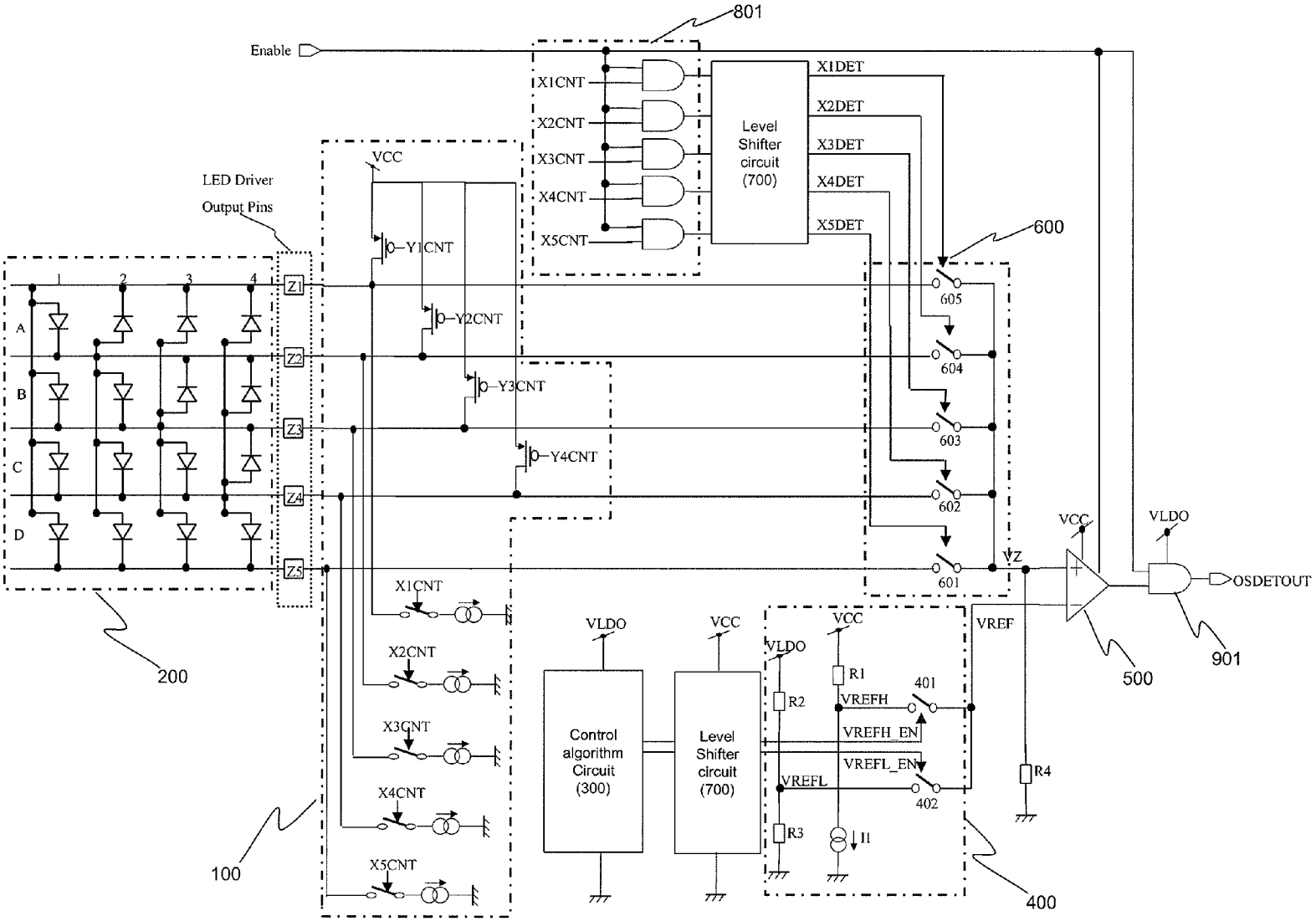
FIG. 3G is an exemplary system diagram, showing exemplary implementations of the output pass block using an AND gate, and the signal pass block using an AND logic circuit.
Figure 3H:
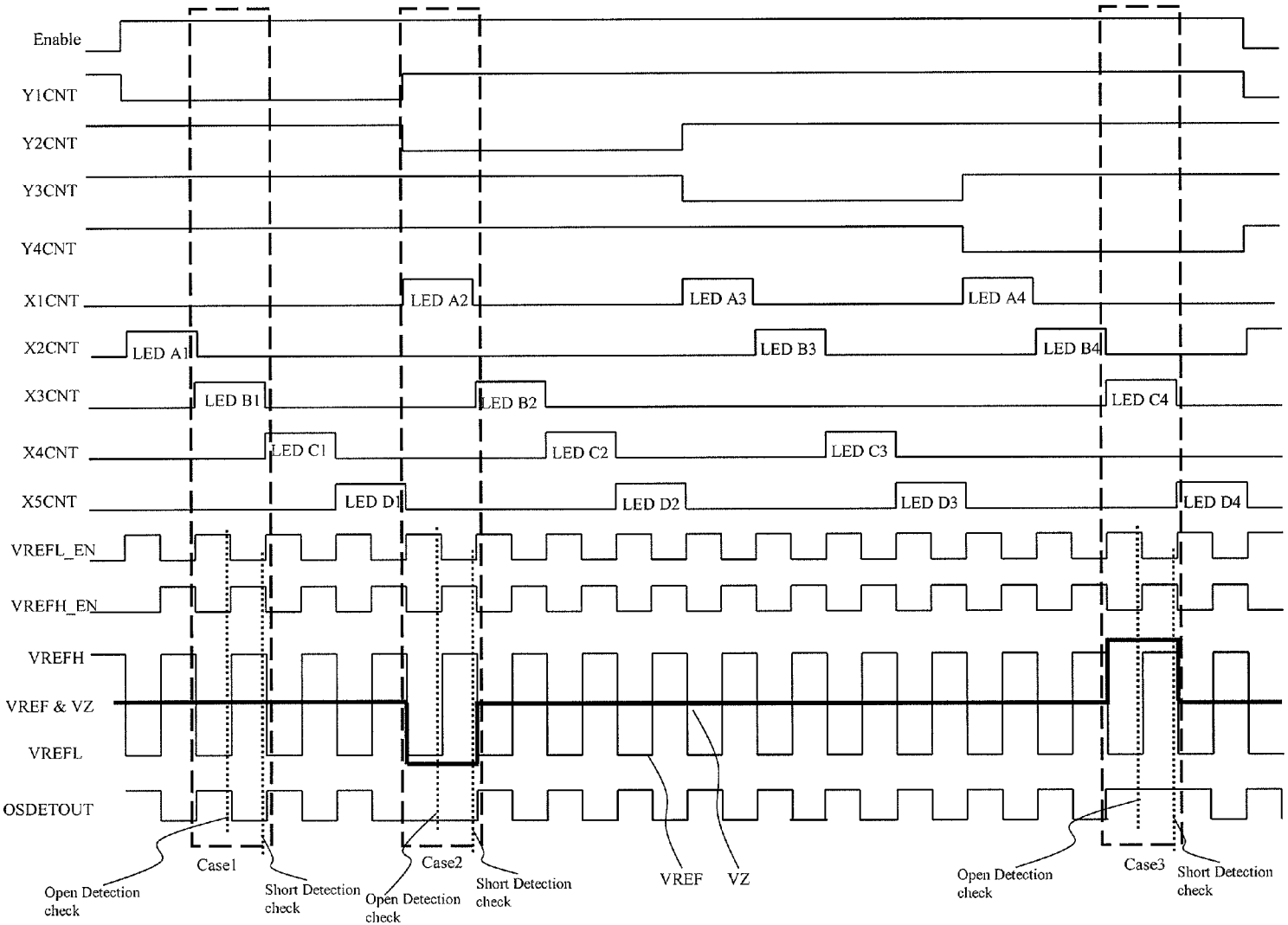
FIG. 3H is an exemplary waveform showing system operation during open/short detection.

As descried earlier, when Enhanced LED Driver system 1000 is enabled via the Enable signal, the Control Algorithm Circuit 300 will start scanning Y*CNT, X*CNT, VREFL_EN & VREFH_EN. Control algorithm circuit 300 will check individual LED through the LED Driver System 100 using Y*CNT and X*CNT. During this individual LED check, the LED output pin voltage of individual LEDs will be connected to the comparator 500 via the Connection Switches Circuit 600. The individual LED pin voltages will be compared with the high and low reference voltages generated by the Reference Generation Circuit 400 to check for open or short condition during the individual LED "ON" period. The output of the comparator 500, COMPOUT will then be allowed to pass through the Output Pass block 900 to the output terminal OSDETOUT when the Enhanced LED Driver system 1000 is enabled. An exemplary implementation of the Output Pass block 900 for this step is by using the AND gate 901 where COMPOUT will be combined or "AND" together with Enable signal. The output terminal OSDETOUT will be sent to Logic Circuit 2000 to update the LED condition. The exemplary system diagram, showing exemplary implementations of the output pass block using an AND gate, and the signal pass block using an AND logic circuit, and waveforms are shown in FIGS. 3G and 3H respectively.

Open detection check will be done before the falling edge of VREFL_EN and open detection information will be updated in the registers via OSDETOUT. Short detection check will be done before the falling edge of VREFH_EN and short detection information will be update in the registers via OSDETOUT.

For normal condition (case 1 in FIG. 3H), output terminal VZ of the Connection Switches Circuit 600 will be higher than VREF (VREFL) during open detection check (VZ>VREFL); whereas the output terminal VZ of the Connection Switches Circuit 600 will be lower than VREF (VREFH) during short detection check (VZ<VREFH).

Open detection occurs when the output terminal VZ of the Connection Switches Circuit 600 is lower than VREF (VREFL) during open detection check (VZ<VREFL). OSDETOUT will output a "LOW" logic signal during open detection register update before the falling edge of VREFL_EN indicating that particular LED is open (see case 2 in FIG. 3H, LED A2 is open).

Short detection occurs when the output terminal VZ of the Connection Switches Circuit 600 is higher than VREF (VREFH) during short detection check (VZ>VREFH). OSDETOUT will output a "HIGH" logic signal during short detection register update before the falling edge of VREFH_EN indicating that particular LED is short (see case 3 in FIG. 3H, LED C4 is short).

Open/short condition of individual LED can be read back using appropriate logic circuits from the registers.

As described, the present invention has been shown to be able to overcome the problem of the inability of US2003/0160703 to detect the open or short condition of individual LEDs arranged in the cross-plex connection.

Having described the above embodiments and detection operation of the invention, various alternations, modifications or improvement could be made by those skilled in the art. Such alternations, modifications or improvement are intended to be within the spirit and scope of this invention.

The above description is by ways of example only, and is not intended as limiting. The invention is only limited as defined in the following claims.

What is claimed is:

1. An apparatus for detecting an open or short condition of a light emitting diode (LED) in a LED panel, the apparatus comprising:

a LED driver system to control the LED panel;

a control algorithm circuit to control the LED driver system;

a connection switches circuit to connect an output pin of the LED to a non-inverting input terminal of a comparator;

a comparator to compare a voltage of the LED output pin with first and second reference voltages;

a reference generation circuit to generate the first and second reference voltages, wherein the LED driver system includes:

a first current source connected to a first terminal of the LED and controlled by a final from the control algorithm circuit, and a second current source connected to a second terminal of the LED and controlled by a signal from the control algorithm circuit.

2. The apparatus according to claim 1, further comprising:

a level shifter circuit to level shift input direct current (DC) voltage levels to a first reference DC voltage level.

3. The apparatus according to claim 2, wherein the first reference DC voltage level is a first power supply voltage.

4. The apparatus according to claim 2, wherein the first reference voltage is generated by voltage dividing a second power supply voltage.

5. The apparatus according to claim 2, wherein the second reference voltage is generated via a small voltage drop across a resistor from a third power supply voltage.

6. The apparatus according to claim 5, wherein the first reference voltage is lower in amplitude compared to the second reference voltage.

7. The apparatus according to claim 5, wherein the third power supply voltage is the same as the first reference DC voltage level.

8. The apparatus according to claim 2, wherein the connection switches circuit comprises a combination of a plurality of switches.

9. The apparatus according to claim 8, wherein the switches are transmission gates.

10. The apparatus according to claim 1, wherein the first current source is a metal oxide semiconductor transistor.

11. The apparatus according to claim 1, further comprising:

a Signal Pass block to allow conditional outputting of LED output pin select signals outputted by said control algorithm circuit, based on an Enable signal; and an Output Pass block to allow conditional outputting of a status of the open or short condition of the LED under test, based on the Enable signal.

12. The apparatus according to claim 11, wherein the Signal Pass block is an AND logic circuit, comprising an array of AND gates.

13. The apparatus according to claim 12, wherein the Output Pass block is a logic AND gate.

14. The apparatus according to claim 1, wherein the LED driver system further includes:

a third current source connected to the second terminal of said LED and controlled by a signal from the control algorithm circuit, and a fourth current source connected to the first terminal of said LED and controlled by a signal from the control algorithm circuit.

* * * * *

UNITED STATES PATENT AND TRADEMARK OFFICE

CERTIFICATE OF CORRECTION

PATENT NO. : 8,558,463 B2
APPLICATION NO. : 13/004283
DATED : October 15, 2013
INVENTOR(S) : Etsuji Sato et al.

It is certified that error appears in the above-identified patent and that said Letters Patent is hereby corrected as shown below:

In the Claims:

At column 7, line 20, claim 1 of the printed patent, “final” should read --signal--.

Signed and Sealed this
Fourth Day of February, 2014

Michelle K. Lee

Michelle K. Lee
*Deputy Director of the United States Patent and Trademark Office*